United States Patent [19]

Germain

[11] Patent Number: 4,868,611

[45] Date of Patent: Sep. 19, 1989

[54] HIGHLIGHT COLOR IMAGING WITH FIRST IMAGE NEUTRALIZATION USING A SCOROTRON

[75] Inventor: Richard P. Germain, Webster, N.Y.

[73] Assignee: Xerox Corporation, Stamford, Conn.

[21] Appl. No.: 131,498

[22] Filed: Dec. 10, 1987

[51] Int. Cl.[4] ..... G03G 15/01

[52] U.S. Cl. ..... 355/328; 430/42

[58] Field of Search ..... 355/4, 30 H, 140 H; 430/42, 902

[56] References Cited

U.S. PATENT DOCUMENTS

| | | | |
|---|---|---|---|
| 3,457,900 | 7/1969 | Drexler | 118/645 |
| 3,900,001 | 8/1975 | Fraser et al. | 118/658 |
| 4,078,929 | 3/1978 | Gundlach | 430/42 |
| 4,308,821 | 1/1982 | Matsumoto et al. | 118/645 |
| 4,397,264 | 8/1983 | Hatoh | 118/656 |
| 4,486,089 | 12/1984 | Itaya et al. | 355/300 |
| 4,525,447 | 6/1985 | Tanaka et al. | 430/122 |
| 4,562,130 | 12/1985 | Oka | 430/54 |
| 4,591,713 | 5/1986 | Gundlach et al. | 250/326 |
| 4,660,961 | 4/1987 | Kuramoto et al. | 355/4 |

*Primary Examiner*—A. T. Grimley
*Assistant Examiner*—J. Pendegrass

[57] ABSTRACT

Highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

34 Claims, 5 Drawing Sheets

HIGHLIGHT COLOR IMAGING WITH FIRST IMAGE NEUTRALIZATION USING A SCOROTRON

BACKGROUND OF THE INVENTION

This invention relates generally to the rendering of latent electrostatic images visible on a charge retentive surface using multiple colors of dry toner or developer supplied by a plurality of developer housings and more particularly to the reduction of interaction between an image rendered visible by developer material supplied by one of the developer housings and developer materials contained in another developer housing.

The tri-level highlight color xerographic process is one method of making single pass, two color images. The basic concept of tri-level xerography is described in U.S. Pat. No. 4,078,929 issued in the name of Gundlach. In this process, the latent image is created by first charging the photoreceptor (p/r) to some initial charge level ($V_o$), and then exposing the p/r to three discrete voltage levels using a Raster Output Scanner (ROS). The two voltages that represent the document information (both colors) are commonly referred to as the Charged Area Development potential ($V_{CAD}$) and the Discharged Area Development potential ($V_{DAD}$). The third voltage represents the white or background potential ($V_{WHITE}$), and corresponds to the background areas or those areas of the document that are to be white. $V_{CAD}$ is generated when the ROS output is minimum (off), and is roughly equal to $V_o$. $V_{DAD}$, on the other hand, is generated when the ROS output is maximum (on full), as is typically equal to the residual potential of the p/r ($<100$v). $V_{WHITE}$ is generated when ROS output is approximately at half power, and is typically equal to $V_0/2$.

Once the tri-level latent image is formed, it is then developed by passing it sequentially through or past two independent developer housings, each containing one of the two required developers. In theory, either of these housings can contain either color developer, and either color developer (specifically, the toner) can be either positive or negative in charge, as long as the two developers are opposite in polarity. For the purpose of this disclosure, it will be assumed that a black developer with positive toner resides in the first housing, and a color developer with negative toner resides in the second housing. Preferably the two developer housings contain conductive magnetic brush developer.

As the latent image passes in close proximity to the first housing, the positive black toner is attracted to and finally deposited in the more negative areas of the p/r, called $V_{CAD}$, and development continues until the $V_{CAD}$ surface potential roughly equals that of the first developer housing bias ($V_{CAD}$ bias). This bias, which is typically $\approx 100$v more negative then $V_{WHITE}$, creates a cleaning field between this housing and both $V_{WHITE}$ and $V_{DAD}$, thus suppressing development of black toner in these areas. When the latent image is passed through the second housing, the negative color toner is deposited in the less negative areas of the p/r, called $V_{DAD}$, until the $V_{DAD}$ surface potential roughly equals that of the second housing bias ($V_{DAD}$ bias). This bias is typically $\approx 100$v less negative then $V_{WHITE}$, and creates a cleaning field between this housing and both $V_{WHITE}$ and the residual $V_{CAD}$ which suppresses development of the negative color toner in these areas.

After development of the tri-level image is complete, one additional step must be implemented prior to transfer. Because the developed image contains toner of both signs (i.e. positive and negative), it must be exposed to a pre-transfer corona (either positive or negative) to make the toners common in sign. Once this is done, the image can then be transferred to paper using conventional electrostatic transfer.

When the tri-level latent image is passed through the first developer area, the $V_{CAD}$ portion of the latent image is developed with black toner. As development takes place, $V_{CAD}$ is reduced in amplitude by a process called neutralization, which is the pairing of negative charges on the p/r with positive charges on the toner particles. In theory, total neutralization (100% ) of $V_{CAD}$ is achieved when enough positive toner is deposited on the p/r to make $V_{CAD}=V_{CAD}$ bias. In practice, however, total neutralization is rarely achieved, and the Post Development (PD) $V_{CAD}$ is typically 30 volts more negative then $V_{CAD}$ bias.

A typical residual tri-level image after development by the first housing which comprises the combination of the residual $V_{CAD}$ after development, defined as ($V_{CAD}$ (PD)+($V_{CAD}$ bias$-V_{WHITE}$)), is on the order of 130 volts. When the latent image is passed through the second housing (which contains the DAD color developer in this case), the presence of the residual $V_{CAD}$ causes high cleaning fields between this residual and the $V_{DAD}$ bias. These cleaning fields, coupled with the weakened magnetics (almost field free) employed in the second housing to minimize the disturbance of the developed CAD image, have the following undesired effects:

1. Because the DAD carrier beads are positive in charge, they are attracted to the more negative regions of the p/r surface. The most negative areas on the p/r prior to entering the second housing are the CAD(PD) areas, and as a result are the areas most likely to suffer deposition of DAD developer beads. The presence of beads in these regions results in large deletions in the CAD image when the image is transferred to paper.

2. Because of the weak magnetics used in the second housing, the effective conductivity of the DAD developer is lower than it would be if it were in the first housing (which uses full strength (i.e. conventional magnetic brush development) magnetics)). As a result, the DAD developer is more likely to respond to fringe fields, such as the ones that exist between $V_{CAD}$(PD) and $V_{WHITE}$, causing color toner to be deposited around the outside of the CAD image areas. This type of deposition has been observed in the past on actual tri-level prints.

3. Any wrong sign toner (positive) contained in the DAD developer will be attracted to, and possibly deposited in, the residual $V_{CAD}$ areas. While this may not be detrimental if the DAD developer is a color (i.e. red in the black is hard to see), it is very harmful if the DAD developer is black.

Various techniques have been employed in the prior art to minimize the disturbance of the first developed image by developer materials in the another housing by which the developed image must pass. By in large such techniques have dealt with the modification of the development apparatus of the second developer system. For example:

There is disclosed in U.S. Pat. No. 4,308,821 granted on Jan. 5, 1982 to Matsumoto, et al, an electrophotographic development method and apparatus using two magnetic brushes for developing two-color images which do not disturb or destroy a first developed image during a second development process. This is because a second magnetic brush contacts the surface of a latent electrostatic image bearing member more lightly then a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster that it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. It is utilized for applying developer material to a developer receiving surface in conformity with an electrostatic charge pattern wherein the developer is transported from the developer supply to a development zone while in a magnetic brush configuration and thereafter, transported through the development zone in a magnetically unconstrained blanket contact with the developer receiving surface.

Disclosed in a patent application (Attorney's Docket No. D/86213) assigned to the same assignee as the instant invention, is a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also the developer is transported from one magnetic roll to the next. This apparatus provides an efficient means for developing the complimentary half of a tri-level latent image while at the same time allowing the already developed first half to pass through the second housing with minimum image disturbance.

As disclosed is U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two magnetic peaks. The sleeve and the magnets are rotated in opposite directions. As a result of the above, it is alleged that a soft developer body is obtained, and density unevenness or stripping of the image is avoided.

While my invention contemplates the use of a modified second developer apparatus it also contemplates the use of a scorotron discharge device for neutralizing of the first residual latent electrostatic image to further minimize the interaction between developer materials contained in a second developer housing and the image already developed by the first developer housing.

It is known in the prior art to expose the charge retentive surface containing a developed image corona discharge. As illustrated in U.S. Pat. No. 4,660,961 granted to Kuramoto et. al. on Apr. 28, 1987, a charging assembly is employed between two developer housings for providing additional uniform positive charge to the photosensitive surface used therein.

U.S. Pat. No. 4,562,130 granted to Tateki on Dec. 31, 1985 discloses the use of a scorotron device which is utilized for stabilizing an unstable intermediate potential on a charge retentive surface for the purpose of enabling the setting of developer bias voltages. The unstable potential area is raised to the grid voltage of the scorotron by exposure of the charge retentive surface to the scorotron discharges. The use of such a scorotron device is also disclosed is U.S. Pat. Nos. 4,525,447 granted to Tanaka on June 25, 1985 and 4,539,2181 granted to Tanaka on Sept. 3, 1985.

U.S. Pat. No. 4,308,821 granted to Matsumoto et al on Jan. 5, 1982 disclose the differential charging of developer material in order to obviate materials interaction due to the stronger attractive forces of the one material and the charge retentive surface.

BRIEF SUMMARY OF THE INVENTION

To eliminate (or at least minimize) the problems discussed above, I have provided a well controlled scorotron charging device of the type disclosed in U.S. Pat. No. 4,591,713 between the two tri-level developer housings. By placing this scorotron between the housings, and applying a DC bias to its control grid that is equal to $V_{WHITE}$, the toned residual $V_{CAD}$ image charge is reduced to the $V_{WHITE}$ level without disturbing the undeveloped DAD portion of the latent image. With both $V_{WHITE}$ and the scorotron control grid at $-400$ volts, and a positive corona present around the scorotron wires, the only time positive current flows through the control grid to the p/r is when regions that are more negative then $-400$ volts are present, namely the residual CAD potential. Because $V_{WHITE}$ is equal to the control grid voltage, and $V_{DAD}$ is actually more positive, no current flows from the scorotron to these p/r regions.

While the foregoing description was made with respect to a tri-level system where CAD developer is contained in the first housing and DAD developer is contained in the second housing it is contemplated that image charge neutralization as discussed above will also work for the case where the DAD developer resides in the first developer housing (and the CAD developer is in the second housing). The only change required to the scorotron would be to apply a negative voltage to the coronode wires in order to produce a negative corona. In this case, the only time current would flow through the control grid is when areas of the p/r that are more positive then $-400$ volts are present, namely the DAD residual. No negative current would flow from the scorotron to the $V_{WHITE}$ or $V_{CAD}$ regions of the p/r, because they are equal to or more negative, respectively, than the control grid.

One additional benefit might be realized when using a scorotron as a neutralization device for the first housing residual potentials. If the charges supplied by the scorotron to these residual potentials increase the charge on the toner rather than decrease the charge on the p/r, then coulomb forces between the toner and p/r should be increased. If this is the case, then the toner present on the p/r prior to entering the second housing should be less likely to be disturbed by the motion of this housing's developer brushes. This might allow stronger magnetics to be employed in the second housing, which should further reduce the bead carryout and fringe field development problems stated previously.

DETAILED DESCRIPTION OF THE PREFERRED EMBODIMENT OF THE INVENTION

Figure 1A:
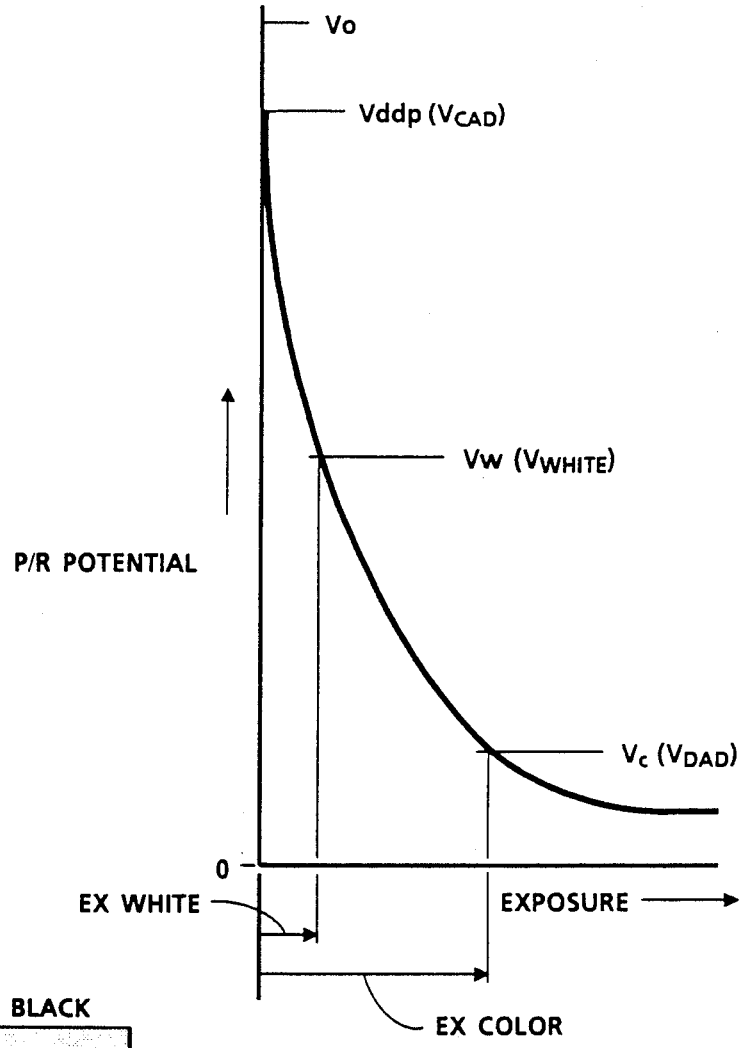
FIG. 1*a* is a plot of photoreceptor potential versus exposure illustrating a tri-level electrostatic latent image.
Figure 1B:
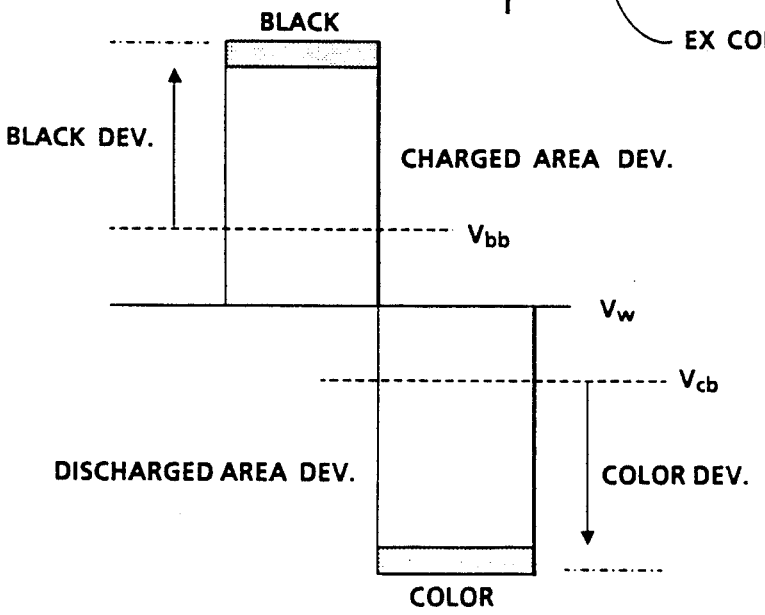
FIG. 1*b* is a plot of photoreceptor potential illustrating single-pass, highlight color latent image characteristics.

For a better understanding of the concept of tri-level imaging, a description thereof will now be made with reference to FIGS 1*a* and 1*b* . FIG 1*a* illustrates the tri-level electrostatic latent image in more detail. Here $V_0$ is the initial charge level, $V_{ddp}$ or $V_{CAD}$ the dark discharge potential (unexposed), $V_w$ the white discharge level and $V_c$ or $V_{DAD}$ the photoreceptor residual potential (full exposure).

The latent image is created by first charging the photoreceptor (p/r) to some initial charge level ($V_o$), and then exposing the p/r which, by virtue of the dark decay phenomenon discharges to $V_{ddp}$, to three discrete voltage levels using Raster Output Scanner (ROS). The two voltages that represent the document information (both colors) are commonly referred to as the Charged Area Development potential ($V_{CAD}$) and the Discharged Area Development potential ($V_{DAD}$). The third voltage represents the white or background potential ($V_{WHITE}$), and corresponds to the background areas or those areas of the document that are to be white. $V_{CAD}$ is generated when ROS output is minimum (off), and is roughly equal to $V_0$. $V_{DAD}$, on the other hand, is generated when the ROS output is maximum (on full), and is typically equal to the residual potential of the p/r ($<$100v). $V_{WHITE}$ is generated when the ROS output is approximately at half power, and is typically equal to $V_{CAD}/2$.

Color discrimination in the development of the electrostatic latent image is achieved by passing the photoreceptor past two developer housings in tandem which housings are electrically biased to voltages which are offset from the background voltage $V_w$, the direction of offset depending on the polarity or sign of toner in the housing. One housing (for the sake of illustration, the first) contains developer with black toner having triboelectric properties such that the toner is driven to the most highly charged ($V_{CAD}$) areas of the latent image by the electric field between the photoreceptor and the development rolls biased at $V_{bb}$ (V black bias) as shown in FIG 1*b*. Conversely, the triboelectric charge on the colored toner in the second housing is chosen so that the toner is urged towards parts of the latent image at residual potential, $V_{DAD}$ by the electric field existing between the photoreceptor and the development rolls in the second housing at bias voltage $V_{cb}$(V color bias).

Figure 2:
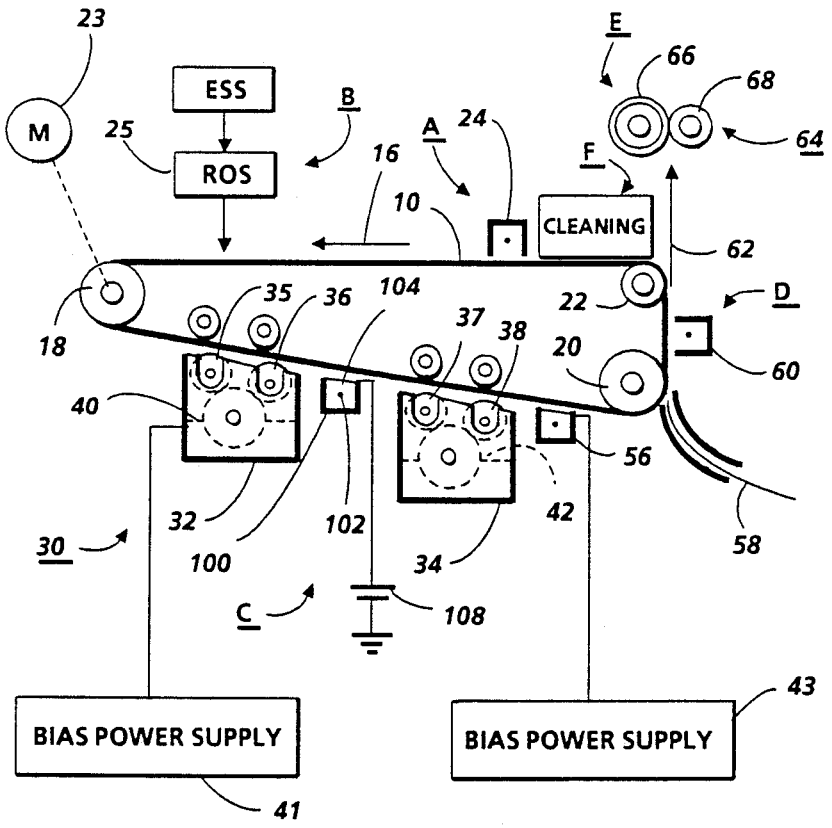
FIG. 2 is schematic illustration of a printing apparatus incorporating the inventive features of my invention.

As shown in FIG. 2, a printing machine incorporating my invention may utilize a charge retentive member in the form of a photoconductive or photoreceptor 10 belt consisting of a photoconductive surface and an electrically conductive substrate mounted for movement past a charging station A, an exposure B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed by a laser based output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$. When exposed at the exposure station B it is discharged to $V_w$ imagewise in the background (white) image areas, to $V_{CAD}$ which is at or near $V_{ddp}$ in the black area and to $V_{DAD}$ which is near zero or ground potential in the highlight (i.e. color other than black) color parts of the image. See FIG. 1*a*.

At development station C, a magnetic brush development system, indicated generally by the reference numeral 30 moves developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains developer with black toner 40 having triboelectric properties such that the toner is driven to the most highly charged ($V_{CAD}$) areas of the latent image by the electrostatic field (development field) between the photoreceptor and the development rolls biased at $V_{bb}$ as shown in FIG. 1*b*. Conversely, the triboelectric charge on the colored toner 42 in the second housing is chosen so that the toner is urged towards parts of the latent image at residual potential, $V_{DAD}$ by the electrostatic field (development field) existing between the photoreceptor and the development rolls in the second housing at bias voltages $V_{cb}$.

In tri-level xerography, the entire photoreceptor voltage difference ($|V_{ddp}-V_c|$, as shown in FIG. 1*a*) is shared equally between the charged area development (CAD) and the discharged area development (DAD). This corresponds to $\approx$800 volts (if realistic photoreceptor value for $V_{ddp}$ of 900 volts and a residual voltage of 100 volts are assumed). Allowing an additional 100 volts for the cleaning field in each development housing ($|V_{bb}-V_{white}|$ or $|V_{white-Vcb}|$) means an actual development contrast voltage for CAD of $\approx$300 volts and an $\approx$ equal amount for DAD. In the foregoing case the 300 volts of contrast voltage is provided by electrically biasing the first developer housing to a voltage level of approximately 600 volts and the second developer housing to a voltage level of 400 volts.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack of copy sheets. Feed rolls rotate so as to advance the uppermost sheet from stack into a chute which directs the advancing sheet of support material into contact with photoconductive surface of belt 10 in a timed sequence so that the toner powder image is developed thereon contacts the advancing sheets of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

The magnetic brush rolls 35 and 36 may comprise any conventional structures known in the art that provide a magnetic field that forms the developer material in the housing 32 into a brush-like configuration in the development zone between the rolls 35 and 36 and the charge retentive surface. This arrangement effects development of one of the two image areas contained on the charge retentive surface in a well known manner.

Figure 3:
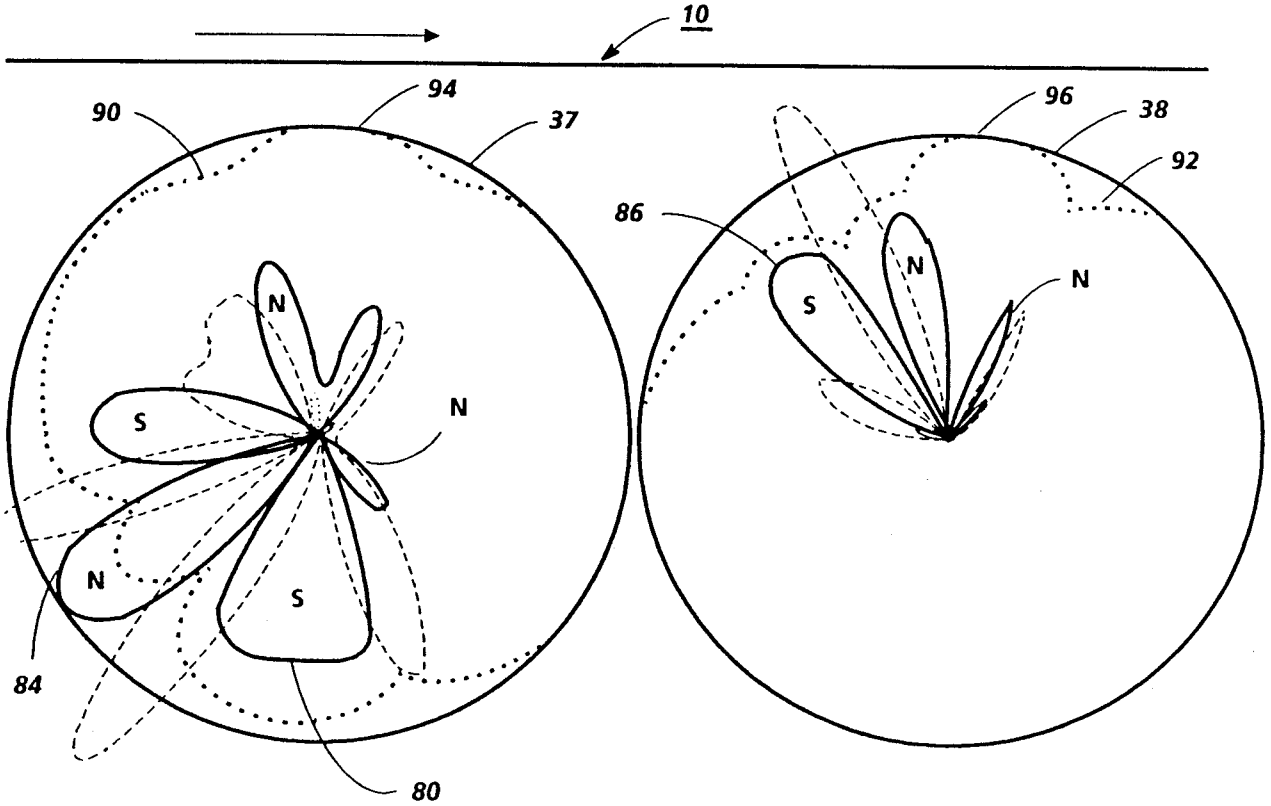
FIG. 3 is a plot of the magnetic fields around the central axis of a two-roll magnetic development system incorporated in printing apparatus of FIG. 2.

The magnetic brush rolls 37 and 38 on the other hand are constructed such that development of the other two images areas is accomplished with minimal disturbance of the first image. To this end, the magnetic rolls 37 and 38 comprise magnetic force fields as depicted in FIG. 3. As shown therein, the radial force profiles of the these two rolls are such as to cause developer to be picked up from the developer housing 34 and conveyed to the top of the roll 37 where the developer becomes magnetically unconstrained. The developer is moved through the development zone in a magnetically unconstrained manner until it is attracted to the roll 38 due to the radial magnetic forces of that roll. Magnetic roles are designated N (north) or S (south). Radial magnetic forces are depicted with solid lines and tangential forces are depicted with dashed lines. As will be appreciated, the rolls 35 and 36 may be fabricated in the same manner as the rolls 37 and 38. Such a construction of rolls 35 and 36 would render them less likely to disturb the latent image which is subsequently developed by the rolls 37 and 38.

FIG. 3 depicts the radial and tangential components, respectively, of rolls 37 and 38. As illustrated in FIG. 3, the magnetic fields are plotted around the central axis of a two-roll magnetic brush development system such as the one comprising rolls 37, 38. For a multiple roll development system comprising more than two rolls, roll 38 is replicated. The rolls are driven synchronously in this example, although it is also possible to have independent drive mechanisms for each roller.

The development system additionally consists of a sump, or reservoir, of magnetic material, and optionally a mixing system, paddle wheel, or other apparatus to maintain the developing properties of the material in the sump. The developer rolls are rotating non-magnetic cylinders or shells having roughened or longitudinally corrugated surfaces to urge the developer along by frictional forces around fixed internal magnets. The shells are driven synchronously in this example; it is also possible to have independent drive mechanisms for each roller.

During the development process of the system, the direction of rotation of the shell around either fixed magnet is clockwise. However, the system can also be configured to develop in the counterclockwise direction with no compromise in performance, depending on the desired properties of the development system with respect to the direction of the photoreceptor (i.e., against-mode or with-mode development).

In the case described, the photoreceptor 10 is located above the development rolls. The developer materials are transported in the direction of the arrow from the sump to roll 37, to roll 38, back to the sump.

A broad radial pole 80 of roll 37 (FIG. 3) positioned at 6 o'clock serves to lift magnetic developer material from a donor roll in the sump or housing 34. The combination of tangential and radial fields starting with pole 84 transport the developer material along the surface of the developer roll until about the 11 o'clock position of roll 37. At that point, the developer becomes magnetically unconstrained due to the lack of poles or strong poles in this area to constrain the developer in a brush-like configuration.

The developer is moved magnetically unconstrained through the part of the development zone delineated by the roll 37 and the charge retentive surface until the developer comes under the influence of a strong radial south pole 86 of the magnet 38. Movement through the aforementioned zone is effected through the cooperation of the charge retentive surface and the developer shell. The pole 86 serves to effect transition of the developer from the roll 37 to the roll 38 without magnetically constraining the developer so as to cause scavenging of the first image as it passes the second developer housing. As will be observed, the poles following the pole 86 in the clockwise direction are progressively weaker so that the developer is magnetically unconstrained as it moves through the part of the development zone delineated by the roll 38 and the charge retentive surface.

Dotted lines 90 and 92 delineate the magnitude of the magnetic force on the developer particles at the various positions around the shell. The direction of the force is toward the center of the rolls. In accordance with the invention, the force on the developer is at a minimum in the nip area between the rolls 37 and 38 as indicated at 94 and 96 on the dotted lines 90 and 92, respectively.

Figure 4:
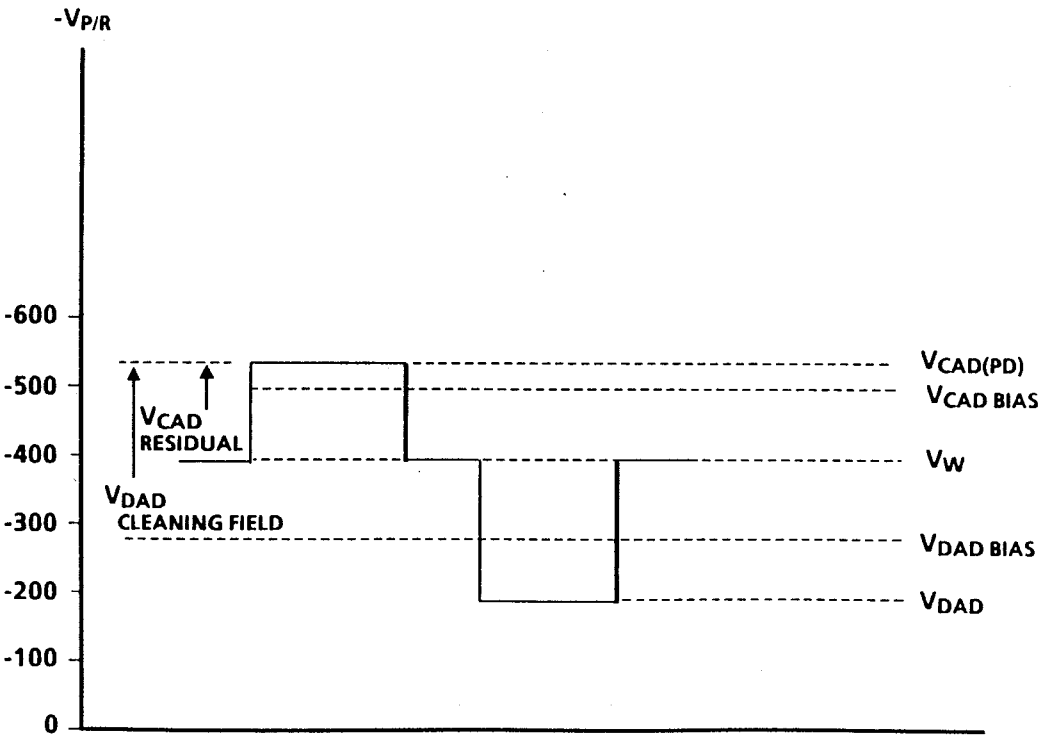
FIG. 4 is a plot of photoreceptor potential illustrating single-pass, highlight color latent image characteristics subsequent to development of the first image of a tri-level image.

The developer system described in connection with the developer housing 32, because of the minimal interaction with the image developed by the housing 34, is considered to be a scavengeless or soft developer system. In operation of the apparatus described hereinabove, when the tri-level latent image is passed through the first developer area, the $V_{CAD}$ portion of the latent image is developed with black toner. As development takes place, $V_{CAD}$ is reduced in amplitude by a process called neutralization, which is the pairing of negative charges on the p/r with positive charges on the toner particles. In theory, total neutralization (100%) of $V_{CAD}$ is achieved when enough positive toner is deposited on the p/r to make $V_{CAD}=V_{CAD}$ bias. In practice, however, total neutralization is rarely achieved, and the Post Development (PD) $V_{CAD}$ is typically 30 volts more negative then $V_{CAD}$ bias. See FIG. 4.

A typical residual tri-level image after development by the first housing which comprises the combination of the residual $V_{CAD}$ after development, defined as ($V_{CAD}$ (PD)+($V_{CAD}$ bias$-V_{WHITE}$)), is on the order of 130 volts. When the latent image is passed through the second housing (which contains the DAD color developer in this case), the presence of the residual $V_{CAD}$ causes high cleaning fields between this residual and the $V_{DAD}$ bias.

To further minimize the interaction of developer materials in the housing 34 with the CAD residual image, I have produced a corona discharge device in the form of a scorotron comprising a shield 100, one or more coronode wires 102 and a conductive grid 104. A suitable scorotron as disclosed in U.S. Pat. No. 4,591,713 comprises a corona generating electrode of short radius, an insulating and partially open shield partially housing the electrode, a source of electrical potential being operatively connected to the electrode to cause the electrode to emit a corona discharge, the coronode being separated from a screen by 4 or 5 mm. The screen is spaced about 1.5 to 2 mm away from the surface to be charged. Impedance to the electrode (coronode) is provided to prevent arcing. The resistance is selected to provide about a 10% drop in potential from the power supply to the electrode.

By placing this scorotron between the housings, and applying a DC bias to its grid 104 that is equal to $V_{WHITE}$, the toned residual $V_{CAD}$ image charge is reduced to the $V_{WHITE}$ level without disturbing the undeveloped DAD portion of the latent image. With both $V_{WHITE}$ and the scortron control grid a $-400$ volts, and a positive corona present around the scorotron wires, the only time positive current flows through the control grid to the p/r is when regions that are more negative then $-400$ volts are present, namely the residual CAD potential. Because $V_{WHITE}$ is equal to the control grid voltage, and $V_{DAD}$ is actually more positive, no current flows from the scorotron to these p/r regions. Thus the effects discussed above vis-a-vis the cleaning fields present when the CAD image is not neutralized by use of the scorotron are substantially eliminated.

While the foregoing description was made with respect to a tri-level system where CAD developer is contained in the first housing and DAD developer is contained in the second housing it is contemplated that image charge neutralization as discussed above will also work for the case where the DAD developer resides in the first developer housing (and the CAD developer is in the second housing). The only change required to the scorotron would be to apply a negative voltage to the coronode wires in order to produce a negative corona. In this case, the only time current would flow through the control grid is when areas of the p/r that are more positive then $-400$ volts are present, namely the DAD residual. No negative current would flow from the scorotron to the $V_{WHITE}$ or $V_{CAD}$ regions of the p/r, because they are equal to and more negative, respectively, than the control grid.

Figure 5:
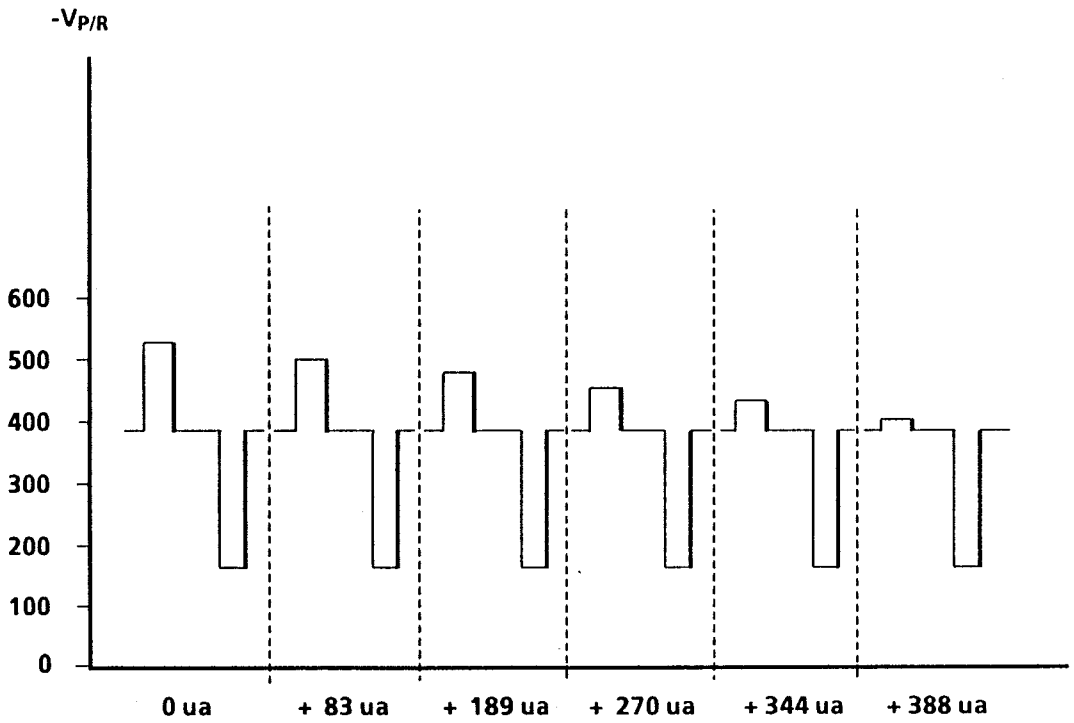
FIG. 5 is a plot of image potentials versus total scorotron current.

The feasibility of using a scorotron of the type described to neutralize the residual $V_{CAD}$, was verified by experimentation using suitable printer. Initially, the printer was configured as shown in FIG. 2, with the exception that the housing 34 was not present and a scorotron was placed immediately after the CAD black developer housing 32. The grid was spaced approximately 0.090" from the p/r. The control grid of the scorotron was biased at $-400$ v, and the coronode wires were connected to a variable high voltage DC power supply. Using a Trek Electrostatic Voltmeter (ESV) probe that was located just after the scorotron, the latent image p/r electrostatics (both developed $V_{CAD}$ and undeveloped $V_{WHITE}$ and $V_{DAD}$) were measured while the scorotron total current was varied from 0 ua to $+390$ ua. The scorotron was varied by adjusting the voltage on the coronode wires from 0v(0 ua) to $+4.8$kv($+390$ ua). Shown in FIG. 5 is the effect that these scorotron currents had on the voltage levels of the tri-level image. As the scorotron current was increased from 0ua to +390 ua, the developed $V_{CAD}$(PD) is reduced from −510 v to −400 v, while absolutely no change in the undeveloped $V_{DAD}$ is observed. Over the same current range, $V_{WHITE}$ decreased from −377 v @0 ua to −361 v @+390 ua, indicating that some modification of $V_{WHITE}$ does occur. However, this change in $V_{WHITE}$ (≈16 v) is quite small compared to the rather large decrease seen in the $V_{CAD}$(PD) potential (≈110 v).

From the above experiment, it was determined that no modification to $V_{DAD}$ occurs when the latent image is exposed to the scorotron current. In order to determine if the resolution of the DAD latent image was disturbed, I configured the printer such that the developer housing 32 was not present while the housing 34 was present. The scorotron and ESV probe, were installed prior to housing 34. The housing contained a DAD black developer. The p/r electrostatics were set to simulate the latent image potentials after development by the first housing CAD developer. The simulated latent image was then developed by the second position DAD housing after it was exposed to scorotron currents of 0 ua, +280 ua, and +390 ua. No obvious difference in either solid area or line development were observed, indicating that he scorotron does not disturb any part of the DAD image.

What is claimed is:

1. Highlight color imaging apparatus including means for forming a single polarity charge pattern having at least three different voltage levels on a charge retentive surface wherein two of the voltage levels correspond to two image areas and the third voltage level corresponds to a background area, said apparatus comprising:

means including a first developer housing containing developer materials for forming a first contrasting image in one of said two image areas;

means including a second developer housing containing developer materials for forming a second contrasting image in the other of said two image areas; and means operative independently of said means including said first and second developer housings for effecting reduction in the interaction of the developer materials in said second developer housing with said first contrasting image on said charge retentive surface, said interaction reducing means comprising means for reducing the charge level of said first contrasting image prior to its movement past said second developer housing.

2. Apparatus according to claim 1 wherein said means for reducing said charge level comprises a corona discharge device.

3. Apparatus according to claim 2 wherein said corona discharge device comprises a well controlled scorotron charging device.

4. Apparatus according to claim 1 wherein the voltage level of said background area is approximately half the level of one of said two potential levels and further wherein said interaction reducing means comprises means for reducing the charge level of said first contrasting image prior to its movement past said second developer housing.

5. Apparatus according to claim 4 wherein said means for reducing charge level reduces the charge level of said first contrasting image to approximately said third voltage level.

6. Apparatus according to claim 4 wherein said means for reducing the charge level comprises a scorotron including a coronode and a grid.

7. Apparatus according to claim 6 wherein the grid of said scorotron is electrically biased to a voltage approximately equal to said third voltage level.

8. Apparatus according to claim 7 wherein a positive voltage is applied to said coronode.

9. Apparatus according to claim 8 wherein said scorotron is disposed between said developer housings.

10. Apparatus according to claim 1 wherein conductive magnetic brush developer is contained in both of said developer housings.

11. Apparatus according to claim 10 wherein the voltage level of said background area is approximately half the level of one of said two potential levels and further wherein said interaction reducing means comprises means for reducing the charge level of said first contrasting image prior to its movement past said second developer housing.

12. Apparatus according to claim 11 wherein said means for reducing charge level reduces the charge level of said first contrasting image to approximately said third voltage level.

13. Apparatus according to claim 12 wherein said means for reducing the charge level comprises a scorotron including a coronode and a grid.

14. Apparatus according to claim 13 wherein the grid of said scorotron is electrically biased to a voltage approximately equal to said third voltage level.

15. Apparatus according to claim 14 wherein a positive voltage is applied to said coronode.

16. Apparatus according to claim 15 wherein said scorotron is disposed between said developer housings.

17. Apparatus according to claim 11 wherein said means for reducing said charge level comprises a corona discharge device.

18. Apparatus according to claim 17 wherein said corona discharge comprises a well controlled scorotron charging device.

19. The method of forming highlight color images including means for forming a single polarity charge pattern having at least three different voltage levels on a charge retentive surface wherein two of the voltage levels correspond to two image areas and the third voltage level corresponds to a background area, said method including the steps of:

forming a first contrasting image in one of said two image areas with developer contained in a first developer housing;

forming a second contrasting image in the other of said two image areas with developer contained in a second developer housing; and modifying said first contrasting image for minimizing the interaction of the developer materials in said second developer housing with said first contrasting image on said charge retentive surface.

20. The method according to claim 19 wherein said modifying step effects reduction in the charge level of said first contrasting image prior to its movement past said second developer housing.

21. The method according to claim 20 wherein said charge level reduction is effected with the use of a corona discharge device.

22. The method according to claim 21 wherein said corona discharge device comprises a well controlled scorotron charging device.

23. The method according to claim 19 wherein the voltage level of said background area is approximately half the level of one of said two potential levels and further wherein said modifying step serves to reduce the charge level of said first contrasting image prior to its movement past said second developer housing.

24. The method according to claim 23 wherein the charge level of said first contrasting image is reduced to approximately said third voltage level.

25. The method according to claim 24 wherein the reduction in the charge level is effected by means of a scorotron including a coronode and a grid.

26. The method according to claim 25 wherein the grid of said scorotron is electrically biased to a voltage approximately equal to said third voltage level.

27. The method according to claim 26 wherein a positive voltage is applied to said coronode.

28. The method according to claim 27 wherein said scorotron is disposed between said developer housings.

29. The method according to claim 19 wherein conductive magnetic brush developer is contained in both of said developer housings.

30. The method according to claim 29 wherein said modifying step effects reduction in the charge level of said first contrasting image prior to its movement past said second developer housing.

31. The method according to claim 30 wherein the reduction in the charge level is effected by means of a scorotron including a coronode and a grid.

32. The method according to claim 31 wherein said corona discharge device comprises a well controlled scorotron charging device.

33. The method according to claim 32 wherein the voltage level of said background area is approximately half the level of one of said two potential levels and further wherein said modifying step serves to reduce the charge level of said first contrasting image prior to its movement past said second developer housing.

34. The method according to claim 33 wherein the charge level of said first contrasting image is reduced to approximately said third voltage level.

* * * * *